United States Patent [19]

Ribnick et al.

[11] 3,997,868

[45] Dec. 14, 1976

[54] EMERGENCY VEHICLE WARNING SYSTEM

[76] Inventors: Gerson D. Ribnick, 606 N. Larchmont Blvd., Los Angeles, Calif. 90004; Steven M. Gorenbein, 47 Alhambra Circle, No. 2, Coral Gables, Fla. 33134

[22] Filed: Jan. 13, 1975

[21] Appl. No.: 540,723

Related U.S. Application Data

[63] Continuation-in-part of Ser. No. 334,159, Feb. 20, 1973, abandoned.

[52] U.S. Cl. ..... 340/33; 325/29; 340/23; 343/112 CA

[51] Int. Cl.[2] ..... G08G 1/16

[58] Field of Search ..... 340/33, 32, 24, 23; 325/29; 346/8; 343/112 CA

[56] References Cited

UNITED STATES PATENTS

| | | | |
|---|---|---|---|
| 1,983,079 | 12/1934 | Hansen | 343/112 CA |
| 2,403,603 | 7/1946 | Korn | 343/112 CA |
| 3,052,882 | 9/1962 | Pidhayny et al. | 340/33 |
| 3,233,217 | 2/1966 | Bost | 340/33 |
| 3,749,893 | 7/1973 | Hileman | 340/24 |
| 3,778,832 | 12/1973 | Carruthers | 340/24 |

*Primary Examiner*—John W. Caldwell
*Assistant Examiner*—James J. Groody
*Attorney, Agent, or Firm*—Don B. Finkelstein

[57] ABSTRACT

A vehicle signaling arrangement in which emergency vehicles are provided with radio frequency signal generating means for generating a radio frequency signal and an antenna for transmitting the radio frequency signal to regions external the emergency vehicle. Preselected other vehicles, which may include passenger cars, trucks, and all other vehicles, and if desired, the emergency vehicles themselves, are provided with radio frequency signal receiver means for receiving the radio frequency signal. Indicator means are coupled to the radio frequency signal receiver means in the preselected other vehicles to indicate the reception of the radio frequency signal and thus indicate the presence of an emergency vehicle. Proximity indicating means may also be provided in the preselected other vehicles for indicating the relative proximity of the emergency vehicle thereto and, if desired, directional means may also be provided in the preselected other vehicles for indicating the relative direction of the emergency vehicle from the preselected other vehicles.

3 Claims, 7 Drawing Figures

EMERGENCY VEHICLE WARNING SYSTEM

REFERENCE TO RELATED APPLICATIONS

This application is a continuation-in-part of our copending patent application Ser. No. 334,159, filed Feb. 20, 1973, now abandoned and the technology thereof is incorporated herein.

BACKGROUND OF THE INVENTION

1. Field of the Invention

This invention relates to the signal transmission and reception art and more particularly to an arrangement for providing a visually and/or audibly detectable signal in a vehicle indicating the presence and/or the proximity and/or relative direction of an emergency vehicle thereto.

2. Description of the Prior Art

Many vehicles, and in particular passenger vehicles, incorporate, as part of their design features, the minimization of external noises penetrating into the passenger compartment. Further, many advertisements for such passenger vehicles particularly point out and stress the quiet conditions in the passenger compartment through the exclusion of externally generated noise, even including the sound of the engine, in the vehicles. While such quietness in the passenger compartment provides a more pleasant atmosphere during riding therein, it has presented a major problem with regards to the driver of such a vehicle being informed of the presence of emergency vehicles such as ambulances, fire equipment, police vehicles or the like.

Such emergency vehicles generally incorporate not only a visual signal, such as a steady or flashing red light, but also various types of audible signal generating devices such as sirens, growlers or the like. The flashing lights require that the emergency vehicle be within direct line-of-sight of the vehicle to be warned of its presence and also that the driver thereof in some way see such a light.

The improved audio insulation qualities of the passenger vehicles has resulted in an increase in the decible level of the noise producing devices of the emergency vehicles. Thus, many present emergency vehicles incorporate such audible signal devices having an intensity level approaching that of physical harm to listener. That is, pedestrians and other people, not in vehicles, can be subjected to auditory damage due to the intensity of such sound. Therefore, the level of intensity available for such audio signal devices in emergency vehicles has approximately approached the limit. However, even sounds generated at this high audio intensity in many instances still do not provide a sufficient warning time to the driver of well audio-insulated vehicles.

In addition, it is often desired not only to know of the presence of an emergency vehicle in the vicinity of the passenger vehicle but also, for greater safety, it is desirable that the driver of the passenger vehicle also be provided with information indicating the relative separation between the vehicle and the emergency vehicle and also, in many instances, the relative direction thereto.

Many systems have heretofor been designed to provide indication of relative distance, that is range, and direction of one vehicle from another. Highly sophisticated systems, such as those utilized in fire control radar, missile guidance and the like provide excellent information content concerning the range and/or relative direction, but are much too expensive and complicated for utilization in a passenger vehicle to indicate the presence of an emergency vehicle and positional relationship to the passenger vehicle.

In other prior art systems that have attempted to provide the driver of, for example, passenger vehicles, with knowledge of the presence of an emergency vehicle in proximity thereto, there has been incorporated merely a radio signal generated in the emergency vehicle and this signal is broadcast by the emergency vehicle for reception in the passenger vehicle. U.S. Pat. No. 3,233,217 provides such a system in which a different tone is utilized for different emergency vehicles and thus the presence as well as the type of emergency vehicle can be detected by the driver of the passenger vehicle or other non-emergency vehicles. Thus, while providing an indication of the presence of such an emergency vehicle there is no indication as to the relative separation, or proximity, between the receiving vehicle and the emergency vehicle nor was there any indication provided to the driver as to the relative direction of the emergency vehicle from the driven vehicle.

U.S. Pat. No. 3,010,499 provides a system capable of installation in all vehicles and the system is responsive to the audio signal output of the emergency vehicle. A microphone and appropriate circuitry are utilized for converting the sound received by the microphone in the other vehicles into a visual or audible signal in the vehicle. However, no indication of the relative separation or relative direction is provided.

Thus, there has not heretofore been provided an inexpensive, reliable system for providing the driver of vehicles with an indication not only of the presence of an emergency vehicle but also of the relative separation and relative direction of the emergency vehicle from the driven vehicle.

SUMMARY OF THE INVENTION

Accordingly, it is the object of the present invention to provide an improved vehicle warning system.

It is another object of the present invention to provide a vehicle warning system that may be installed in all vehicles, emergency as well as non-emergency, providing an indication of the presence of an emergency vehicle in proximity thereto.

It is yet another object of the present invention to provide a vehicle warning system in which the driver of a vehicle is provided with an indication of the presence of the emergency vehicle, the relative separation, or proximity, of the emergency vehicle therefrom and/or relative direction of the emergency vehicle therefrom.

The above and other objects of the present invention are achieved, according to a preferred embodiment thereof, by providing a radio frequency signal generating means mounted in all emergency vehicles. The radio frequency signal generating means generates a radio frequency signal at a preselected frequency. In those embodiments wherein it is desired that the other vehicles be apprised not only of the presence of an emergency vehicle but also the relative separation between the emergency vehicle and other vehicles, the radio frequency signal generated in the emergency vehicle has a preselected signal strength.

An antenna means is coupled to the radio frequency signal generating means and transmits the generated radio frequency signals to regions external the emergency vehicle. The antenna means transmits the signal in any desired pattern. That is, it may be a whip antenna for omni-directional signal, a parabolic antenna for trapezoidal or clover leaf pattern, or the like. Thus, in such an embodiment the antenna design of the emergency vehicle provides a directional indicating means.

Other vehicles such as passenger vehicles, trucks, and, if desired, even the emergency vehicles themselves, are provided with a radio frequency signal receiver means that is tuned to receive the particular frequency of the generated radio frequency signal. An indicator means is coupled to the radio frequency receiver means in the passenger compartment and in response to the receipt of the radio frequency signal by the radio frequency receiver means generates detectable signals. The detectable signal may be, for example, a steady or flashing light, a source of audible signals such as a buzzer or the like, or any combination thereof. These signals provide the driver of the vehicle with an indication that an emergency vehicle is within the presence of the vehicle. In order to provide an indication of the relative separation between the vehicle and the emergency vehicle, or proximity, a signal strength meter (which may be abbreviated as S meter,) such as a volt meter, may be coupled to the radio frequency signal receiver means to measure the strength to the incoming signal. If the overall system design and installation in all emergency vehicles is controlled to provide that the radio frequency signal generated by each emergency vehicle has the same strength, the strength of the received signal is an indication of the relative separation. That is, precise ranging is not required and effects of atmospheric attenuation or the like may be ignored since only a rough approximation of the relative separation is required. Further, by observing the changes in the reading on the signal strength meter the driver of the vehicle obtains information as to whether the emergency vehicle is approaching, in which case the signal strength increases, receding, in which case the signal strength decreases, or maintaining substantially the same separation, in which case the signal strength stays constant.

In other embodiments the intensity of a light may be utilized as an approximation of the distance separation. That is, the light intensity may be comparatively dim when the signal received is comparatively weak, indicating a comparatively large separation, and the light intensity may grow progressively stronger as the strength of the received signal increases, thereby indicating a closer approach of the emergency vehicle.

When it is desired to provide an indication for relative direction of the emergency vehicle from the other vehicle it has been found that the indication may be provided utilizing, as a reference, the earth's magnetic field. In such an embodiment the radio frequency signal generating means may incorporate a plurality of tone generating means, one for each relative direction it is desired to provide. For example, it may be a two-tone generating means incorporated for indicating a North-South direction of travel of the emergency vehicle and an East-West direction of travel of the emergency vehicle. A greater number of such directions may also be provided by increasing the number of tone generating means. Each tone generating means generates a different frequency signal which is carried on the radio frequency signal generated in the radio frequency signal transmitter. A compass switch is provided in the emergency vehicle responsive to the direction of orientation of the emergency vehicle with respect to the earth's magnetic field. The compass switch has a plurality of contacts thereon. Each of the tone generating means is connected to one of the contact means of the compass switch. As the emergency vehicle orientation with respect to the earth's magnetic field varies, one of the tone generating means will be activated at all times to generate a particular tone, carried on the frequency radio frequency signal.

The indicator means in the other vehicles may also incorporate a compass switch for indicating the orientation of the other vehicle with respect to the earth's magnetic field. Additionally, a plurality of visual indicating means, such as lights, may be arranged in the approximation of a compass rosette and the number of lights corresponding to the number of different tone frequencies carried by the radio frequency signal generated by the emergency vehicles. Each set of lights is then activated by a particular tone frequency carried by the radio frequency signal and thus indicates the orientation of the emergency vehicle. The driver of the other vehicle may then easily determine the relative direction of the emergency vehicle therefrom by the information content in the indicating means by comparing the emergency vehicle orientation with the driven vehicle orientation with respect to the earth's magnetic field.

DESCRIPTION OF THE PREFERRED EMBODIMENTS

As noted above, the present invention contemplates the generation of radio frequency signals transmitted from an emergency vehicle and the radio frequency signals transmitted from the emergency vehicle are received by a radio frequency signal receiver mountable in other vehicles to provide the drivers of the other vehicles with an indication of the presence of the emergency vehicle and, preferably, also an indication of the relative separation, or proximity, and/or relative direction of the emergency vehicle from the other vehicle. It will be appreciated that, as utilized herein, the term "other vehicles" refers to all vehicles such as passenger cars, trucks, and even the emergency vehicles themselves. However, only the emergency vehicles have the radio frequency signal transmitter arrangement mountable therein.

Figure 1:
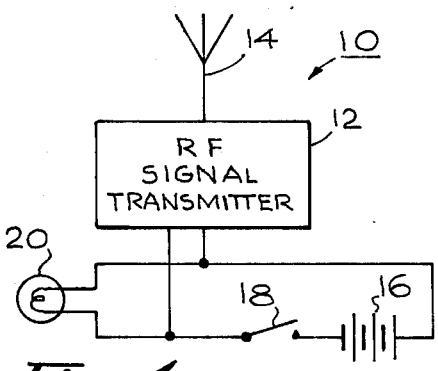
FIG. 1 illustrates a schematic diagram of one embodiment of a radio frequency signal transmitting arrangement mountable in an emergency vehicle.

Referring now to FIG. 1 there is shown a schematic diagram of one embodiment, generally designated 10, of a radio frequency signal transmitter arrangement mountable in an emergency vehicle. Radio frequency signal transmitter arrangement 10 has a radio frequency signal transmitter 12 coupled to antenna 14. The radio frequency signal transmitter 12 generates radio frequency signals having a preselected radio frequency and, if desired, a preselected signal strength. The antenna 14 transmits the signals to regions external of the emergency vehicle. If desired, the antenna means may be designed to provide a degree of directionality indication in cooperative interaction with the radio frequency signal receiver mountable in other vehicles, as described below in greater detail. Thus, the antenna 14 may be a whip antenna to provide an omni-directional signal which, of course, would not provide any degree of directionality interaction but only provides a presence indication. Alternatively, of course, the antenna 14 may be parabolic to provide a trapezoidal or clover leaf pattern, or may be designed to provide, for example, a semicircular pattern directed towards the forward direction of the emergency vehicle. Any other type of antenna design for any particular radiation pattern may also be utilized as desired.

The radio frequency signal transmitter 12 is powered by a source of electrical energy such as the emergency vehicle battery 16 operated through a switch 18. The switch 18 may provide individual operation of tha radio frequency signal transmitter 12 or, alternatively, may be combined with other signaling devices in the emergency vehicle such as the siren, growler, flashing lights or the like. A signal light 20 is also provided in the emergency vehicle to indicate operation of the radio frequency signal transmitter 12.

Figure 2:
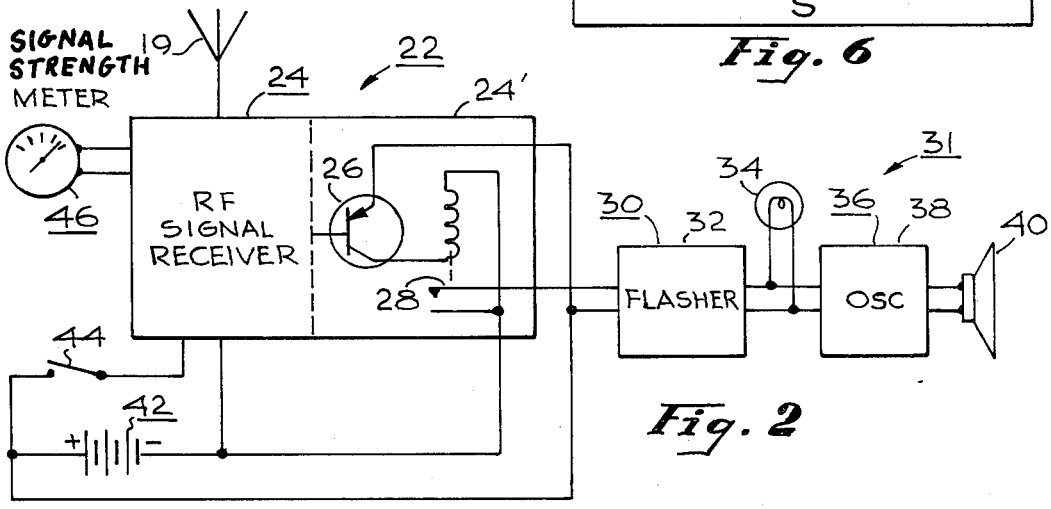
FIG. 2 is a schematic diagram of a radio frequency signal receiver arrangement mountable in other vehicles.

FIG. 2 is a schematic diagram of a radio frequency signal receiver arrangement, generally designated 22, that is mountable in the other vehicles such as the passenger cars, trucks, or even the emergency vehicles, and is generally comprised of a radio frequency signal receiver means 24 connected to receiving antenna 19 for receiving the radio frequency signals generated by the radio frequency signal transmitter 12. Radio frequency signal receiver means 24 may be, for example, a superheterodyne receiver tuned to the specified frequency or frequencies of the transmitted radio frequency signal. The radio frequency signal receiver means 24, in the embodiment 22 shown on FIG. 2, is provided with an amplifier section 24' having a transistor 26 therein. When the signal is received by the radio frequency signal receiver means 24 emitter to collector conduction of the transistor 26 is achieved. The transistor 26 is connected to a relay 28 which, for example, may be a single pole single throw normally open relay. It will be appreciated, of course, that solid state devices may be utilized in the place of the relay 28 and in place of any other relays illustrated schematically herein.

The relay 28 is connected to a source of electromagnetic radiation in the visual portion of the electromagnetic radiation spectrum 30 which may comprise a flasher 32 connected to a light bulb 34. When the relay 28 is closed the flasher circuit is activated and the light 34 flashes "on" and "off".

If desired, of course, the flasher 32 may be omitted and the light bulb 34 connected to relay 28 to provide a continuous emission of electromagnetic radiation in the visual portion of the electromagnetic radiation spectrum for the condition of a radio frequency signal of the correct frequency being received by the radio frequency signal receiver means 24.

A source of audible signals 36 is also provided and connected through the flasher 32 to the relay 28 and the source of audible signals 36 may comprise an audio oscillator 38 for generating an audible signal that is broadcast through a speaker means 40. The speaker means 40 may be a separate speaker means incorporated as part of the embodiment 22 or the speaker means 40 may be, for example, the radio speaker already installed in the vehicles. In those embodiments of the present invention wherein the radio speaker is utilized it may be desirable to provide circuitry (not shown) to switch "off" the radio if it is "on" whenever a signal is received by the radio frequency signal receiver means 24.

The embodiment 22 is powered by a source of electrical energy 42, which may be the vehicle battery, operated through a switch 44 which, preferably, is the ignition switch of the vehicle. Thus, whenever the vehicle is operating the ignition switch is "on" and switch 44 is closed providing circuit operation.

The circuitry thus described for the embodiment 22 provides an indication of the presence of an emergency vehicle by providing both an audible signal and visually detectable signal. However, in many applications it is also desired to know the relative separation, or proximity, between the emergency vehicle and the vehicle containing the embodiment 22. In order to achieve an indication of the relative separation a signal strength meter 46, which, as noted above may be a volt meter, is coupled to the radio frequency signal receiver means 24. The signal strength meter 46 may be calibrated in any desired units, such as feet, yards or the like and is responsive to the strength, that is, for example, the voltage, of the radio frequency signal received by the radio frequency signal receiver means 24. In such an embodiment, of course, the radio frequency signal transmitter 12 is designed to provide a substantially constant preselected strength, that is, for example, voltage, to the transmitted radio signals. When the signal has such a preselected strength, the separation between the emergency vehicle and the other vehicles is determined by utilization of such a proximity indicating means as the signal strength meter.

The radio frequency signal receiver arrangement 22 may be conveniently tested at any desired location, for example, at car service stations or the like, by providing such stations with a low power radio frequency signal transmitter, generally similar to the radio frequency transmitter 12 except of much lower power signal strength in order that the operation of the radio frequency signal receiver arrangement 22 may be checked.

Figure 3:
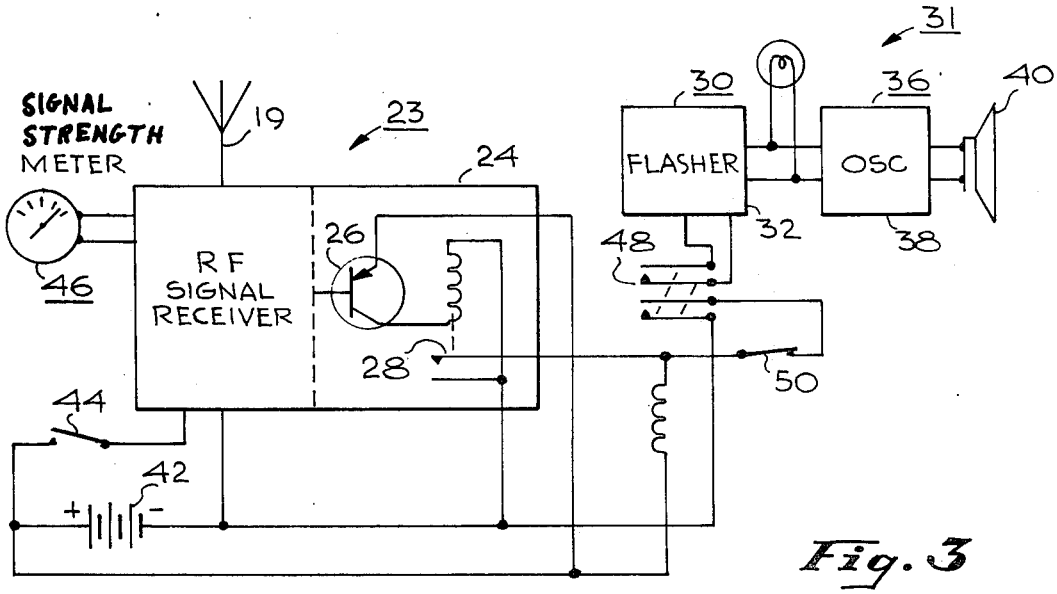
FIG. 3 is a schematic diagram of another embodiment of a radio frequency signal receiver arrangement mountable in other vehicles.

The embodiment 22 described above may be conveniently fabricated in a dashboard mountable unit providing installation in existing vehicles as well as providing circuitry for incorporation into the overall design of new vehicles. As noted above, operation of the embodiment 22 is essentially passive on the part of the vehicle driver. That is, the embodiment 22 is automatically triggered when an emergency vehicle is in the presence thereof and the indicator means 31, comprising the source of visual signals 20 and source of audible signals 36, are automatically turned on for the condition of the radio frequency signal receiver means 24 receiving the proper frequency radio signal. It is automatically turned off when such a signal is no longer present. However, in some embodiments it may be desired to have the vehicle driver take affirmative action in connection with the operation. FIG. 3 illustrates an embodiment, generally designated 23, that is similar to the embodiment 22, except that a double pole, single throw relay 48 is connected to the relay 28 through a normally closed push button switch 50. For the condition of the radio frequency signal receiver means 24 receiving the proper frequency radio signal the relay 48 is closed and the circuit remains energized to provide operation of the indicator means 31, even though the emergency vehicle may have passed beyond the range for actuation thereof until deactivated by operation of the switch 50.

In the embodiments of the present invention described above it can be seen that not only presence of the emergency vehicle but an actual indication of the relative separation of the emergency vehicle from the other vehicle is achieved.

In some applications, however, it may be desired to provide an indication not only of the presence and relative separation, or proximity, between the emergency vehicle and the other vehicle but also an indication as to the relative direction of the emergency vehicle from the other vehicle. It has been found that utilizing the earth's magnetic field as a base reference, a convenient indication of the relative direction of the emergency vehicle from the receiving vehicle may be accomplished.

Figure 4:
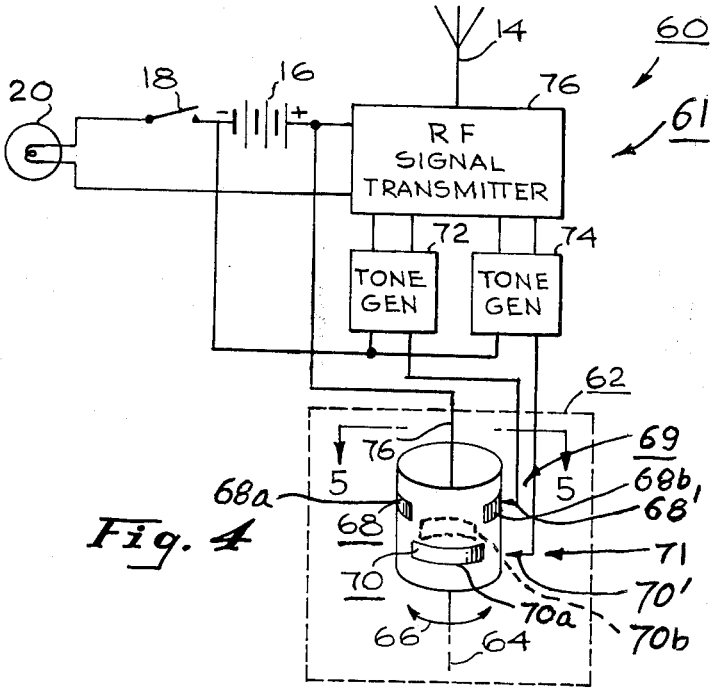
FIG. 4 is a schematic diagram of another embodiment of a radio frequency signal transmitter arrangement mountable in an emergency vehicle.

FIG. 4 illustrates an embodiment, generally designated 60, of a radio frequency signal generator means 61 mountable in emergency vehicles for providing a two axis indication of the direction of the emergency vehicle. To achieve this there is provided, in the emergency vehicle, a compass switch 62 which, for example, may be of the oil bath variety, having a compass drum 63, adapted to rotate about the axis 64 in the directions indicated by the double ended arrow 66 depending upon the orientation of the emergency vehicle with respect to the earth's magnetic field. The compass drum 63 of the compass switch 62 is provided with, in this embodiment 60, two contact means 68 and 70 thereon. The contact means 68 extend over a predetermined number of compass degrees and may be utilized to indicate an orientation of the emergency vehicle in approximately the North-South direction. The contact means 70 extend over a predetermined number of compass degrees and may be utilized to indicate an orientation of the emergency vehicle approximately in the East-West direction. In such an application it is also desired that there by no "dead" spots in the transmission and thus the contact means 68 and 70 may be very slightly overlapping so that each contact means 68 and each contact mean 70 selectively provide an indication of the orientation of the emergency vehicle in a given predetermined band of compass degrees.

The compass switch 62 also comprises fixed wiper means 68' for engaging contact means 68 on drum 63 and fixed wiper means 70' for engaging contact means 70 on the drum 63. The drum 63 rotates about axis 64, as noted above, and wiper means 68' and 70' are selectively engaged by contact means 68 and 70. The contact means 68 has two portions **68*a* and 68*b*. Contact means portion 68*a* is centered about the North direction of compass drum 63 and extends approximately 90°. Similarly, contact means portion 68*b* is centered about the South direction of compass drum 63 and extends approximately 90°. Contact means portions 70*a* and 70*b* are centered about the West direction and East direction, respectively, of compass drum 63 and each extends approximately 90°. To insure that there are no "dead" spots, each contact means portion may, if desired, extend for approximately 91°, to provide a ½° overlap. Thus, fixed wiper means 68' engages contact means portion 68*a* for the Northeast to Northwest quadrant of the compass drum 63 and contact means 68*b* for the Southeast to Southwest quadrant. Similarly, fixed wiper means 70' engages contact means portion 70*a* for the Northwest to Southwest quadrant of compass drum 63 and contact means portion 70*b*** for the Northeast to Southeast quadrant.

The radio frequency signal generator means also comprises a pair of tone signal generating means 72 and 74 coupled to a radio frequency signal transmitter means 76, which may be similar to the radio frequency signal transmitter means 12 described above except that it generates a radio frequency signal carrying the tone signals generated by tone signal generating means 72 or 74. Tone signal generating means 72 is coupled to the fixed wiper means 68' and generates a tone signal at a first preselected tone frequency for the condition of the emergency vehicle aligned within the preselected band of compass degrees approximately centered along the North-South axis as defined by contact means portions **68*a* and 68*b*. The first tone signal frequency generated by the tone signal generator 72 and transmitted to the radio frequency signal transmitter means 76 is transmitted to regions external the emergency vehicle by being carried on the radio frequency signal generated in the radio frequency signal transmitter means 76 as radiated by the antenna means 14. Tone signal generating means 74 is connected to the fixed wiper means 70' and generates a tone signal at a second preselected tone frequency, different from the first preselected tone frequency, for the condition of the emergency vehicle aligned within a preselected band of compass degrees centered approximately along the East-West axis as defined by contact means portions 70*a* and 70*b*. The tone signal frequency generated by tone signal generating means 74 is carried by the radio frequency signal generated in the radio frequency signal transmitter means 76 and is radiated by antenna means 14**.

Thus, depending upon the relative orientation of the emergency vehicle with respect to the earth's magnetic field, either the first or second tone frequency signal is carried by the radio frequency signal transmitted to regions external the emergency vehicle.

Slack wires 77 are utilized to provide connection to the contacts 68 and 70 and thus into the remainder of the circuitry in order to allow for proper operation of the compass switch 62.

Thus, the contact means 68 and wiper means 68' together cooperatively interact to comprise a selective connection means 69 for selectively controlling the tone generator means 72. Contact means 70 and wiper means 70' together cooperatively interact to comprise a selective connection means 71 for selectively controlling the tone generator means 74.

Where it is desired to provide an indication also of the relative separation of the emergency vehicle and the other vehicles it is preferable that the radio frequency signals transmitted by the antenna 14 have preselected signal strengths.

In order to provide an indication of the relative direction of the emergency vehicle from the other vehicles, the other vehicles are preferably provided with a directional means showing the relative orientation of such other vehicle as well as the relative orientation of the emergency vehicle with respect to the earth's magnetic field.

Figure 6:
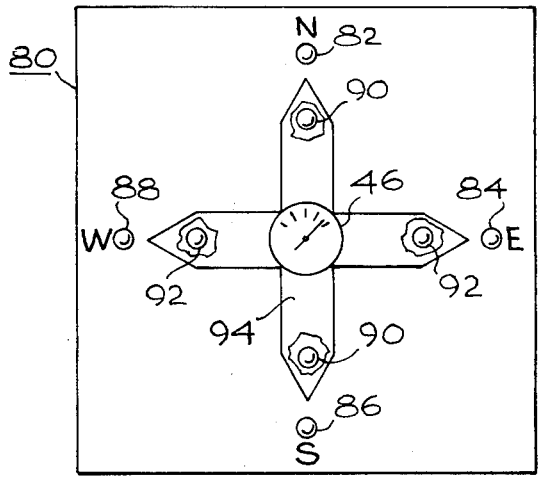
FIG. 6 illustrates an indicator means useful in the practice of the present invention.

FIG. 6 illustrates an indicator means, generally designated 80, useful in such an embodiment of the present invention for installation in such other vehicles and incorporating directional indicating means thereon. As shown, the indicator means 80 is provided with four light bulbs 82, 84, 86 and 88 connected to a compass switch, as described below in greater detail in connection with FIG. 7, which are illuminated depending upon the relative orientation of the vehicle with respect to the earth's magnetic field.

A first pair of light bulbs 90 are provided and are illuminated when an emergency vehicle is in the presence of the vehicle and is oriented within the North-South direction with respect to the earth's magnetic field. A second pair of light bulbs 92 are illuminated when the emergency vehicle is oriented within the East-West direction with respect to the earth's magnetic field. The first pair of light bulbs 90 and second pair of light bulbs 92 are positioned behind, for example, a glass or other translucent or transparent panel 94. If desired, a signal strength meter 46 may be positioned within the indicator means 80 so that a single unit contains all of the desired visual information to be transmitted to the driver of the vehicle.

Figure 7:
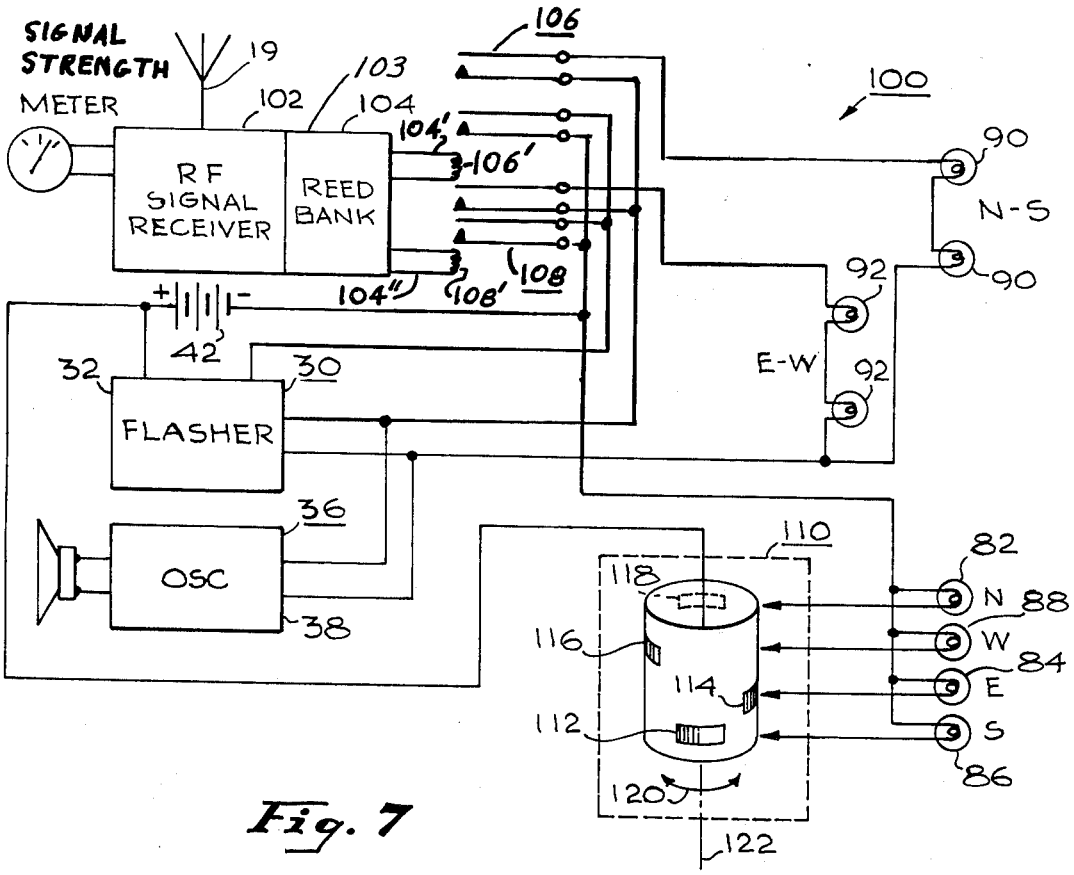
FIG. 7 is a schematic diagram of another embodiment of a radio frequency signal receiver arrangement mountable in other vehicles.

FIG. 7 is a schematic diagram of a radio frequency signal receiving means for installation in other vehicles and incorporating the indicator means 80 and useful in the practice of the present invention in cooperation with the radio frequency signal transmitter arrangement 60 shown on FIG. 4. Radio frequency signal receiver means, generally designated 100, shown in FIG. 7, is comprised of a radio frequency signal receiver means 102 which may be similar to radio receiver means 24 described above except it is designed to receive radio frequency signals carrying the tone frequency signals generated in the tone generators 72 and 74. The output of the radio frequency signal receiver means 102 is connected to a tone signal detection means 103 which, for example, may be a reed bank 104 having two outputs 104' and 104''. Output 104' is connected to the operating coil 106' of double pole, single throw relay 106. Output 104'' is connected to the operating coil 108' at double pole, single throw relay 108. The relay 106 controls the operation of the North-South light bulbs 90 and the relay 108 controls the operation of the East-West light bulbs 92. The reed bank 104 provides individual output signals depending upon the particular tone frequency carried by the radio signal received by the radio frequency signal receiver 102. Thus, when the tone signal frequency carried by the radio frequency signal corresponds to that generated by tone generator 72 relay 106 is energized and light bulbs 90 are illuminated, indicating to the driver of the other vehicle that the emergency vehicle is aligned within the North or South quadrant. Similarly, when the tone signal frequency carried by the radio frequency signal is that generated by tone generator 74 relay 108 is energized and the East-West bulbs 92 are illuminated indicating that the emergency vehicle is within the East or West quadrant. A flasher 32 and audio oscillator 38 may be provided so that the North-South bulbs 90 and/or the East-West bulbs 92 are flashed when the appropriate signal is received by the radio frequency signal receiver 102 and an audible signal is also generated.

A compass switch 110 is utilized to control the operation of the bulbs 82, 84, 86 and 88 and compass switch 110 is generally similar to the compass switch 62 described above except that the compass switch 110 is provided with four contact means 112, 114, 116 and 118. The contact means 118 controls the operation of the North bulb 82, the contact means 116 controls the operation of the West bulb 88, the contact means 114 controls the operation of the East Bulb 84, and the contact means 112 controls the operation of the South bulb 86. The compass switch 110 rotates in the direction of the arrow 120 about the axis 122 depending upon the relative orientation of the vehicle with respect to the earth's magnetic field.

A signal strength meter 46 may be connected to the radio frequency signal receiver means 102 in order to provide an indication of the strength of the signal received through the receiving antenna 19 and thus provide an indication of the relative separation between the emergency vehicle and the other vehicle, as described above.

Figure 5:
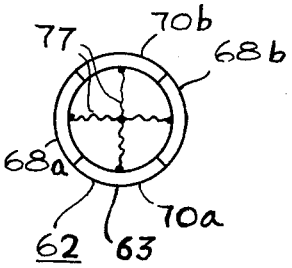
FIG. 5 is a view along the line 5—5 of FIG. 4.

Thus, in the embodiment of the invention incorporating the radio frequency signal transmitter arrangement 60 shown on FIGS. 4 and 5 in the emergency vehicle, and the radio frequency signal receiver arrangement 100 shown on FIG. 7 carried by other vehicles, not only is the presence of the emergency vehicle detected but also indications are given as to the relative separation of the vehicles as well as the relative direction of the vehicles. Overlap between the contacts 112, 114, 116 and 118 may also be provided so there is no possibility of a "dead" spot.

While a two axis reference has been described above, it will be appreciated that any desired number of axes may be utilized. That is, in the emergency vehicle, a plurality of tone generating means greater than two and a corresponding plurality of selective connections means on the compass switch 62 greater than two may be incorporated in the radio frequency signal generator arrangement 61 for more than just North-South and East-West axes orientation indication of the emergency vehicle. Similarly, the appropriate reed bank connections and number of relays, such as relays 106 and 108, connected thereto, in the other vehicles, may be increased to correspond thereto so that additional pairs of lights similar to the lights 90 and 92 may be provided for correspondingly indicating such other compass orientations of the emergency vehicle. The number of contact means on the compass switch 110 in the other vehicles may be increased together with a corresponding increase in the number of indicating bulbs greater than the four bulbs 82, 84, 86 and 88 for providing more precise information of the orientation of the other vehicle with respect to the earth's magnetic field.

In the embodiments described above the relative separation between the emergency vehicle and the other vehicle has been indicated by a signal strength meter such as a volt meter. It will be appreciated that light bulbs may also be utilized to indicate the relative separation. In such an arrangement the voltage to the light bulbs is varied in proportion to the strength of the signal received by the radio frequency signal receiver and thus the intensity of the output of the light bulb is an indication of the relative separation. In such an embodiment, of course, no indication of terms of units of length is provided. Similarly, the flasher may be controlled in response to the strength of the signal received such that the lights flash slowly for a weak signal received and increase in flash frequency as the separation decreases.

Those skilled in the art may find many variations and adaptations of the present invention and the appended claims are intended to cover all such variations and adaptations falling within the true scope and spirit thereof.

We claim:

1. A vehicle signaling arrangement comprising, in combination:

radio frequency signal generating means mounted in emergency vehicles for generating a radio frequency signal having a preselected frequency, and comprising:

a radio frequency signal transmitting means for transmitting said radio frequency signal; a plurality of tone generating means coupled to said radio frequency signal transmitting means, and the number of said tone generating means comprises two, and each of said plurality of tone generating means generating a tone signal having a preselected tone frequency and each of said tone frequencies different from each other, and said radio frequency signal selectively carrying each of said tone signals:

a compass switch means comprising:

a plurality of selectively operable connecting means such responsive to different orientations of said emergency vehicles with respect to the earth's magnetic field, and each of said plurality of selectively operable connecting means coupled to one of said tone generating means for selectively controlling the generation of said tone signal thereby;

a first of said plurality of selectively operable connecting means controlling a first of said tone generating means for the condition of said orientation of the emergency vehicles within a preselected number of compass degrees of a North-South axis, and a second of said plurality of selectively operable connecting means controlling the second of said tone generating means for the condition of said orientation of the emergency vehicles within a predetermined number of compass degrees of the East-West axis;

antenna means coupled to said radio frequency transmitter means for transmitting said radio frequency signal to regions external said emergency vehicles;

radio frequency signal receiver means mounted in other vehicles for receiving said radio frequency signal generated by said radio frequency signal generating means, and comprising:

a radio frequency signal receiver;

a tone signal detection means coupled to said radio frequency signal receiver for detecting said tone signal frequencies carried by said radio frequency signal, and providing a plurality of output signals in response to detection of said tone signal frequencies, each of said plurality of output signals responsive to only one tone signal;

indicator means coupled to said tone signal detection means for receiving said plurality of output signals therefrom and generating a plurality of unique detectable signals different from each other in response to each of said tone signal detection means output signals; and, vehicle orientation indicating means mounted in said other vehicles for generating detectable signals indicating the orientation of said other vehicles relative to the earth's magnetic field.

2. The arrangement defined in claim 1 wherein:

said radio frequency signal generated by said radio frequency signal generating means in said emergency vehicles has a preselected signal strength; and, signal strength indicating means coupled to said radio frequency signal receiver means in said other vehicles for detecting the signal strength of said received radio frequency signal and generating a detectable signal in response thereto, thereby indicating the relative separation between said emergency vehicles and said other vehicles.

3. The arrangement defined in claim 2 wherein said indicator means in said other vehicles further comprises:

a source of electromagnetic radiation for generating signals in the visual portion of the electromagnetic radiation spectrum; and, a source of audible signals.

* * * * *